United States Patent [19]

Ludwig et al.

[11] Patent Number: 4,707,865

[45] Date of Patent: Nov. 24, 1987

[54] DISPENSER WITH FLUID PATHWAY INCLUDING VALVE TO FORM AIR LOCK

[75] Inventors: Clifford J. Ludwig, Southgate, Ky.; Anthony D. Delia, West Redding, Conn.

[73] Assignee: The Drackett Company, Cincinnati, Ohio

[21] Appl. No.: 891,708

[22] Filed: Jul. 31, 1986

[51] Int. Cl.[4] ..... E03D 9/02

[52] U.S. Cl. ..... 4/228; 4/227; 4/222

[58] Field of Search ..... 4/227, 228, 222, 231; 222/424.5, 181, 431

[56] References Cited

U.S. PATENT DOCUMENTS

| | | | |
|---|---|---|---|
| 4,453,278 | 6/1984 | Doggett et al. | 4/228 |
| 4,485,500 | 12/1984 | Melville, Jr. | 4/228 |
| 4,491,988 | 1/1985 | Mizuno | 4/228 |
| 4,534,071 | 8/1985 | Russomanno | 4/228 |
| 4,581,777 | 4/1986 | Newgard et al. | 4/228 |

*Primary Examiner*—Henry K. Artis

*Attorney, Agent, or Firm*—G. Warzecha

[57] ABSTRACT

A toilet tank dispenser having an inlet/outlet tube and including a valve which restricts water flow in one direction while not substantially restricting water flow in the opposite direction. The valve causes the water flowing into the inlet/outlet tube during the filling cycle to flow sufficiently slowly to create an air space in the tube. The air space becomes an air bubble in the top of the inlet/outlet tube during quiescent periods to isolate the dispenser contents from the tank.

4 Claims, 15 Drawing Figures

DISPENSER WITH FLUID PATHWAY INCLUDING VALVE TO FORM AIR LOCK

BACKGROUND OF THE INVENTION

1. FIELD OF THE INVENTION

This invention relates to a novel chemical dispenser for dispensing a predetermined volume of chemical solution into a body of water such as the water in a toilet tank. More particularly, it relates to a dispenser wherein the chemical solution contained in the dispenser is effectively isolated from the body of water during the periods of quiescence.

2. DESCRIPTION OF THE PRIOR ART

There are many types of dispensers for releasing various chemicals such as detergents, disinfectants, etc. into toilet tanks. Depending upon the chemical being utilized there is a need for the dispenser to release the chemical at varying rates. For example, a disinfectant solution to be effective should be released into the tank during the latter portion of the flushing cycle so that the solution is not flushed away. It is desirable in each of these dispensers to provide a means for isolating the chemical solution from the tank during quiescent periods. This prevents unnecessary and wasteful leakage of chemicals into the tank. Dispensers for achieving such a isolation of chemicals are generally categorized as passive or active.

Passive dispensers achieve their purpose without moving parts by proper dimensioning of the ports and internal passages of the dispenser. For example, U.S. Pat. No. 4,208,747 (Dirksing), describes a chemical solution dosing dispenser for dispensing the solution into a toilet tank when the toilet is flushed. This device employs a trapped air bubble in the siphon tube to provide an air lock which, in the quiescent period between flushes, isolates the solution in the dispenser from the water in the tank. To form the air bubble Dirksing forms the upper end of his siphon tube into a hook that has a constricted diameter and which forms a pocket in which air can collect during the filling cycle when water from the toilet tank is entering the dispenser.

A disadvantage of the Dirksing device is, however, its manufacture is complicated by the fact that the operation of the device is highly dependent upon its relative internal dimensions.

Active dispensers achieve their isolating function with some type of moving component such as a valve. The valve is designed to open or close at various times in the flushing cycle in order to release the proper amount of chemical solution only during desired portions of the cycle. Active dispensers are necessarily more complex than passive dispensers and are subject to consumer misuse. Such dispensers are also more difficult to produce since manufacturing tolerances of the various parts are more critical than other dispensers and since they require more parts and assembly operations.

One example of an active dispenser is shown in U.S. Pat. No. 3,778,849 (Foley). The Foley device utilizes two valves in conjunction with ports and tubes having predetermined dimensions. The valves open and close in response to varying pressures which change as a function of the water level within the toilet tank.

A passive means for forming an isolating air lock is disclosed in a co-pending application assigned to the same assignee. The porous member used in that device, however, restricts the discharge rate into the tank which, in some situations, may be undesirable.

It is an object of this invention to produce a toilet tank dispenser which can control the rate at which a chemical solution is dispensed and which utilizes an active means to create an air lock. It is a further object of this invention to produce such a dispenser where the air lock forming means does not restrict the discharge rate of the dispenser.

SUMMARY OF THE INVENTION

These and other objects of this invention are achieved by the preferred embodiment disclosed herein which is, in a dispenser for the controlled-rate release of a substance into a toilet tank, said dispenser having an inlet/outlet means for alternately receiving and discharging liquid into and from said dispenser, said dispenser having an air vent tube for communicating the interior of said dispenser to atmospheric pressure, the improvement comprising valve means situated in the water flow path within said dispenser for limiting the flow of water into said dispenser during the filling cycle of said dispenser in order to enable the formation of an air bubble in said inlet/outlet means to prevent fluid communication between the interior and exterior of said dispenser during quiescent periods.

DESCRIPTION OF THE PREFERRED EMBODIMENT

Figure 1:
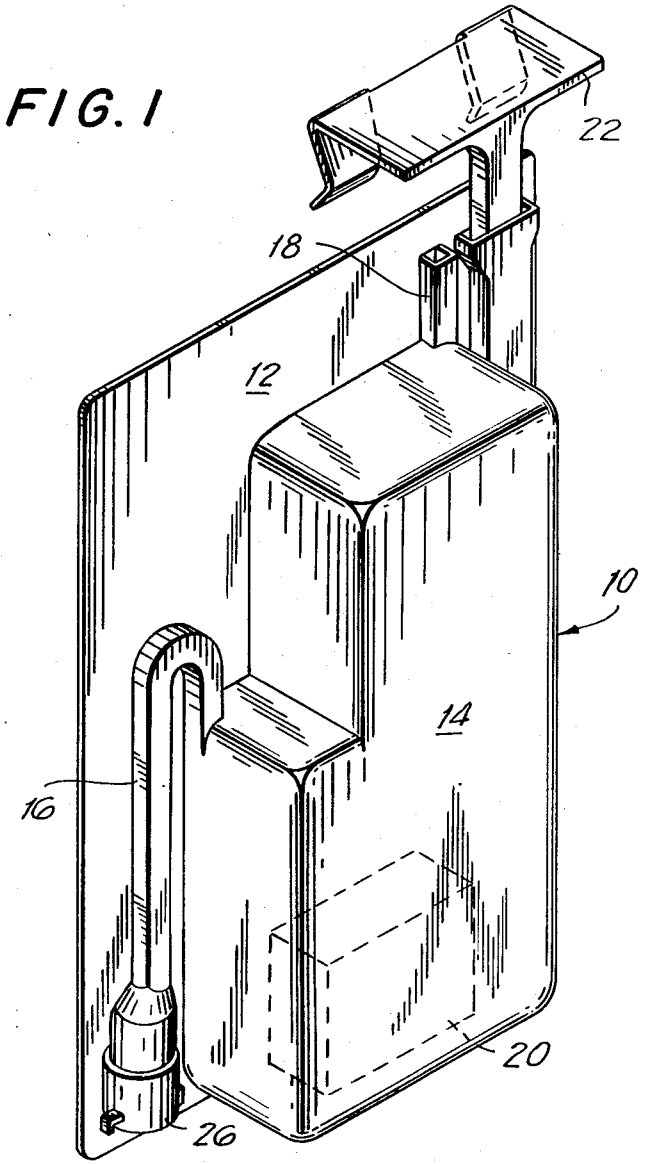
FIG. 1 is a front perspective view of a preferred embodiment of a dispenser constructed in accordance with the principles of this invention.

Referring now to FIG. 1, there is shown a front perspective view of dispenser 10 constructed in accordance with the principles of this invention.

Dispenser 10 includes a base or support 12 upon which is mounted or integrally molded a container 14 having an inlet/outlet conduct tube 16 and an air vent tube 18. Container 14 includes a tablet of a predetermined chemical 20 for being dissolved into the water in container 14. Dispenser 10 also includes a hanger 22 for suspending the dispenser at a predetermined level within tank 24. Ball valve housing 26 is provided at the end of inlet/outlet conduct tube 16. It will be understood that, while dispenser 10 is shown as a gravity fed device, the invention is applicable also to siphon type devices.

Figure 2:
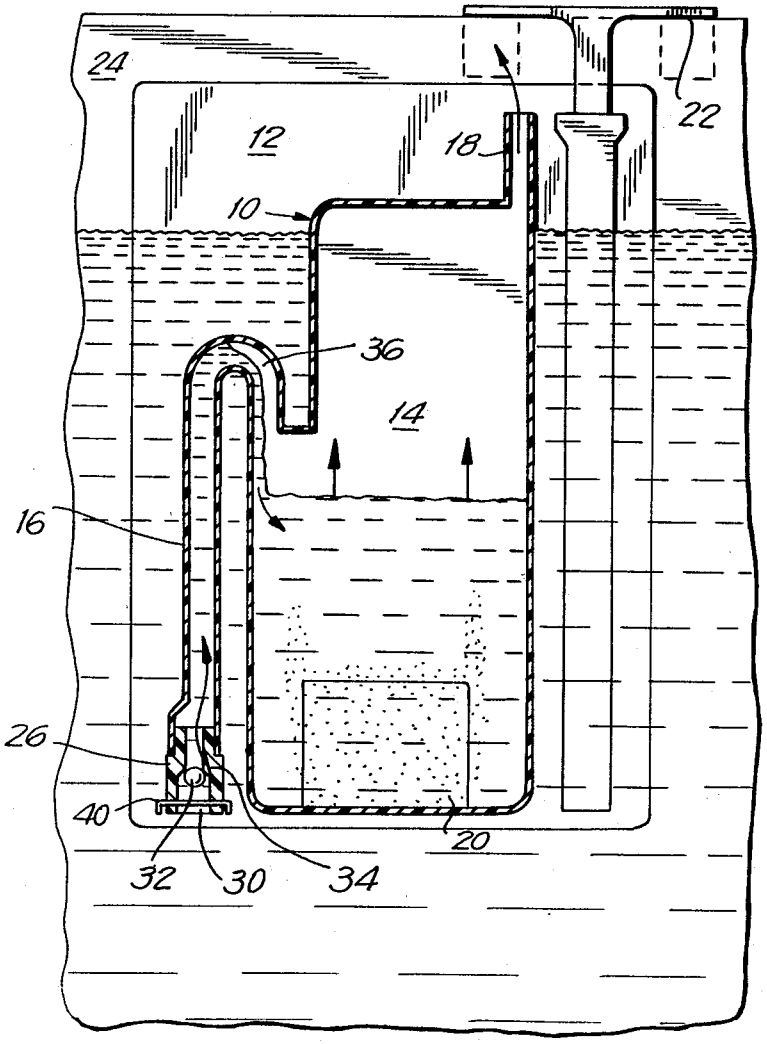
FIG. 2 is a front elevational view in cross-section of the dispenser shown in FIG. 1 during the filling cycle.
Figure 3:
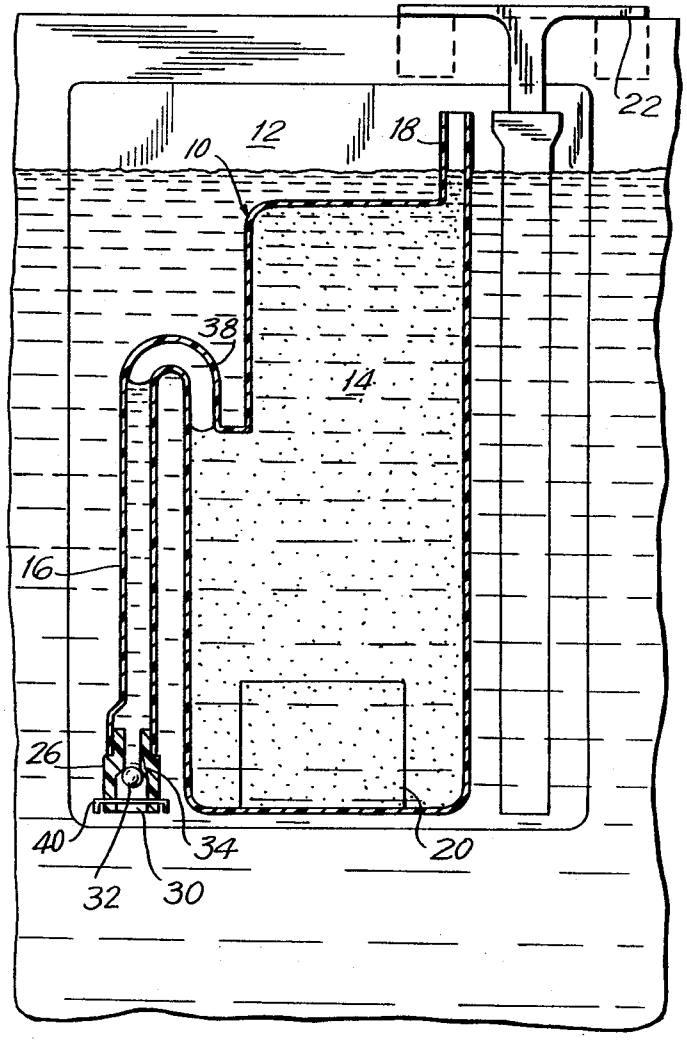
FIG. 3 is a view of FIG. 2 during the quiescent period.
Figure 5:
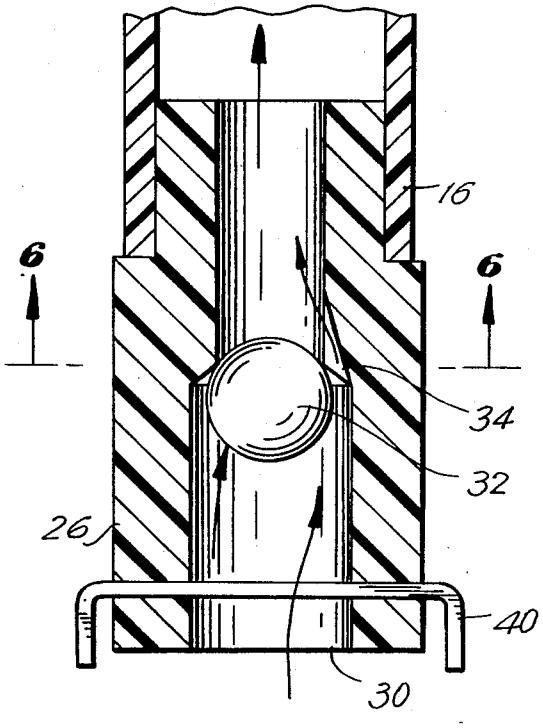
FIG. 5 is an expanded view of a portion of FIG. 2.
Figure 6:
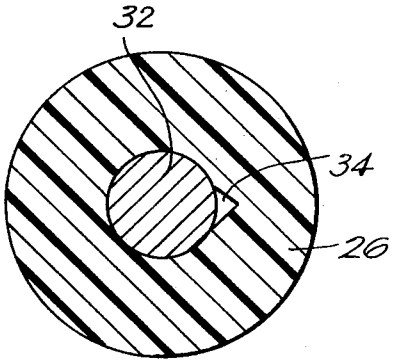
FIG. 6 is a cross-sectional view of FIG. 5 taken along lines 6—6.

Referring now to FIG. 2, dispenser 10 is shown during a portion of the filling cycle. As water enters ball valve housing 26 through inlet port 30 it may pass past a bouyant ball 32 through an aperture 34 formed in the valve seat (best seen in FIGS. 5 and 6). The incoming water pushes air out of container 14 via vent tube 18. The rate at which water is allowed to enter container 14 is restricted by the valve and by the size of tube 16 so the water trickles over the top of tube 16 to create an air space 36 which develops into an air bubble 38 during the quiescent period as best seen in FIG. 3.

Figure 4:
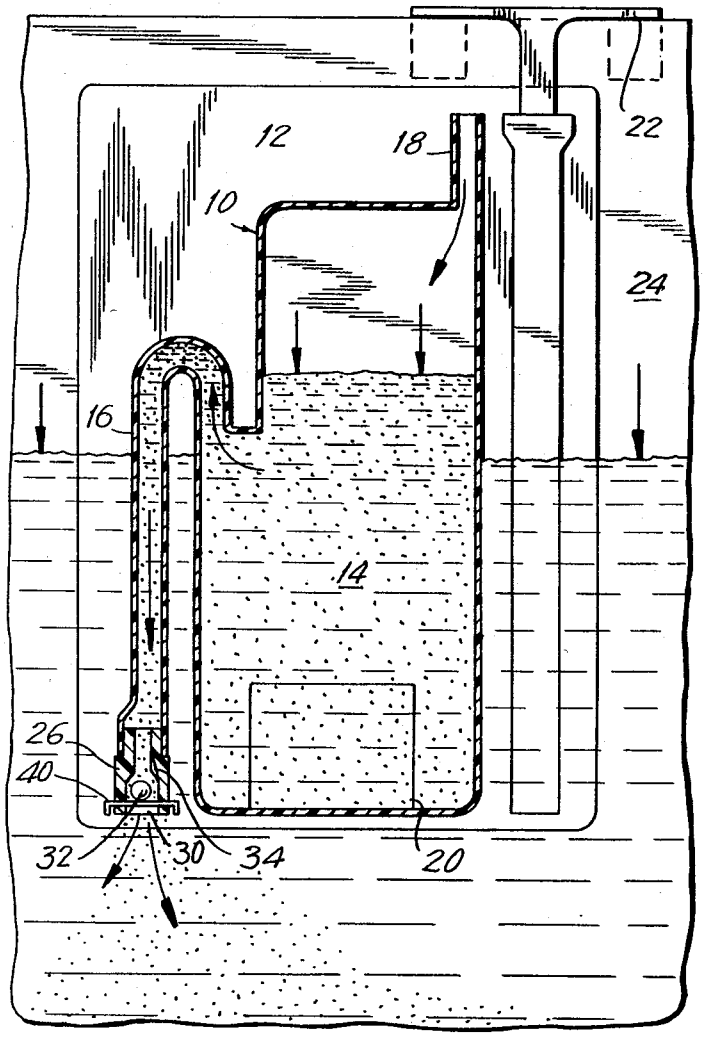
FIG. 4 is a view of FIG. 3 shown during the initial portion of the flushing cycle.

Referring now to FIG. 4, the initial portion of the flushing cycle is shown. As the water level in tank 24 drops rapidly, ball 30 will be pulled down against stop bar 40 by the water exiting from container 14. In this position, the ball valve does not restrict the rate at which the contents of the dispenser are discharged. The size of tube 16 and the space between ball 30 and housing 26 are large enough to ensure that there is no undesirable restriction.

Figure 7:
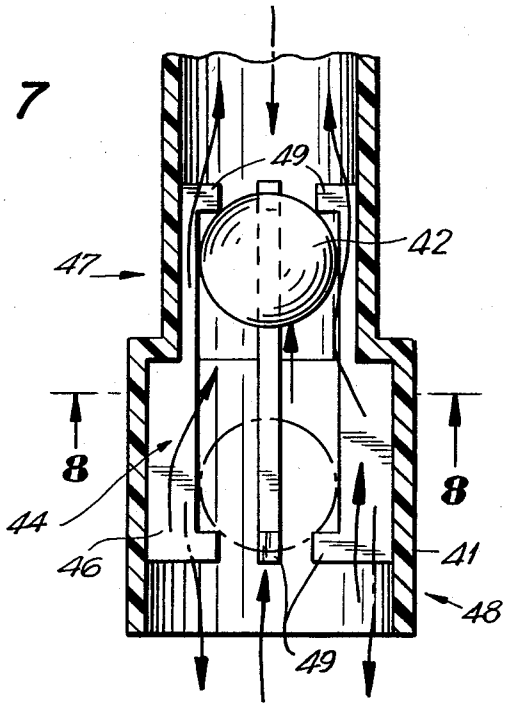
FIG. 7 is an alternate embodiment of the ball valve shown in FIG. 5.
Figure 8:
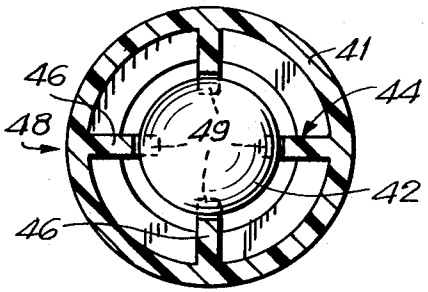
FIG. 8 is a cross-sectional view of FIG. 7 taken along the lines 8—8.

Referring now to FIGS. 7 and 8, there is shown an alternate embodiment of a ball valve having a housing 41 for being inserted into the end of tube 16. The housing is provided with a buoyant ball 42 moveable within a cage assembly 44 formed of four longitudinally extending brackets 46. Cage assembly 44 and housing 40 are made to create an upper portion 47 and lower portion 48 where the space between the ball and the internal surface of housing 40 is relatively small when the ball is in upper portion 47 and relatively large when the ball is in lower portion 48. Tabs 49 retain the ball within cage assembly 44.

Figure 9:
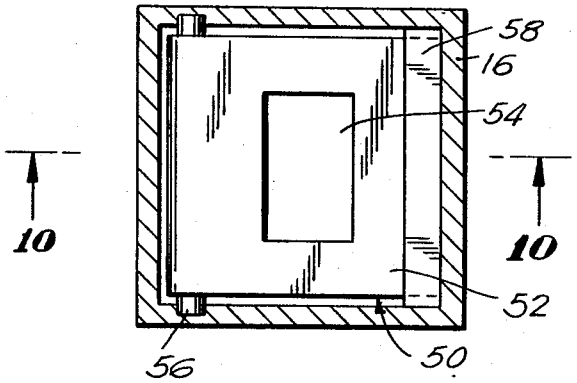
FIG. 9 is an alternate embodiment of another valve arrangement.
Figure 10:
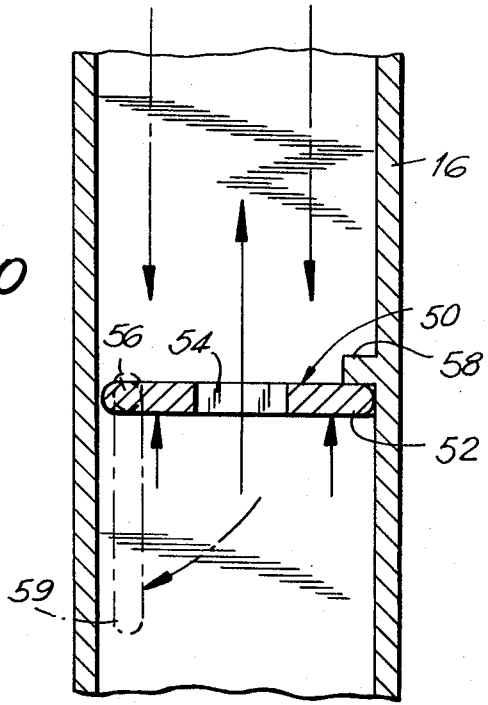
FIG. 10 is a view of FIG. 9 taken along the lines 10—10.

Referring now to FIGS. 9 and 10, there is shown yet another embodiment of a valve 50 which may be used within tube 16 to restrict water flow in one direction. In this embodiment, tube 16 is rectilinear and valve 50 comprises a flap 52 having an aperture 54 of predtermined size. Flap 52 is hinged on pin 56 and, in the closed position (during the filling cycle) is intended to rest against stop 58. During the discharge portion of the cycle flap 52 will be moved by the outflowing water to position 59 shown in phantom.

Figure 11:
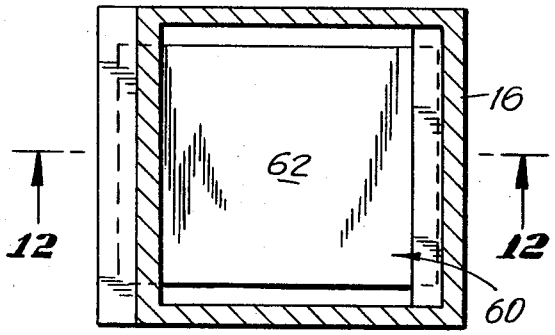
FIG. 11 is a view of another alternate embodiment of a valve arrangement.
Figure 12:
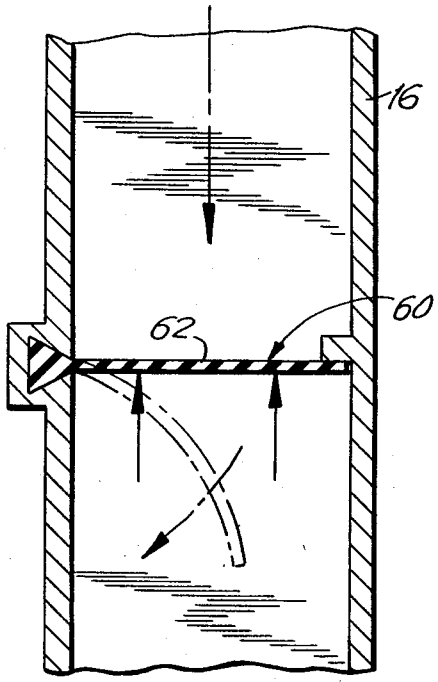
FIG. 12 is a view of FIG. 11 taken along the lines 12—12.

Referring now to FIGS. 11 and 12, there is shown another valve embodiment 60 having an elastomeric flap 62, one side of which is secured to the interior of rectilinear tube 16. Spaces of predetermined size exist between the edges of flap 62 and the interior of tube 16 to serve as means for restricting water flow during the filling cycle. As in the previous embodiment, the flap will bend out of the way under the force of water during the discharge portion of the cycle.

Figure 15:
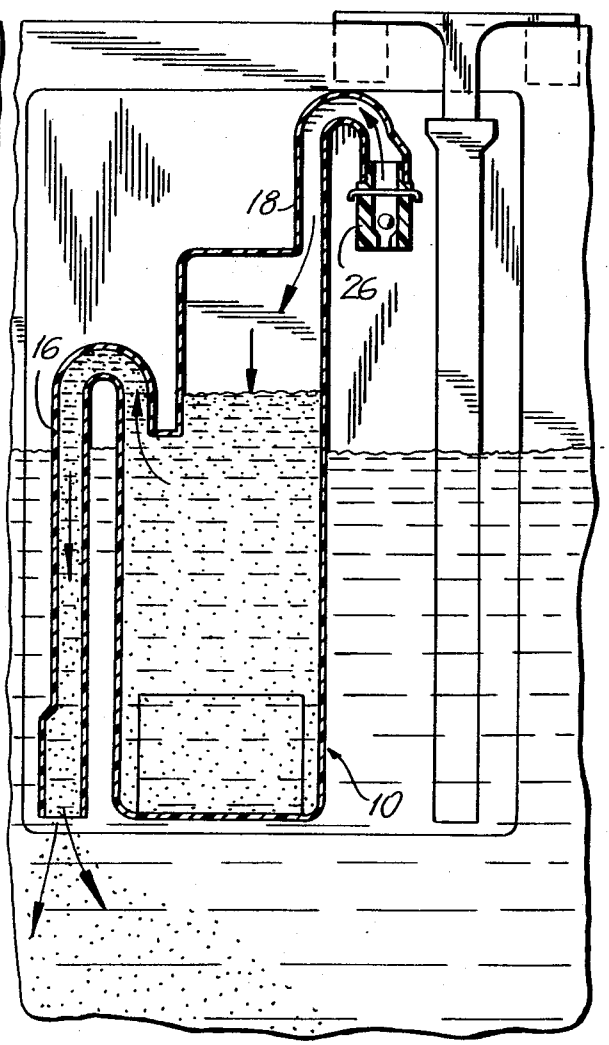
FIG. 15 is a view of FIG. 14 taken during the initial portion of the flushing cycle.
Figure 14:
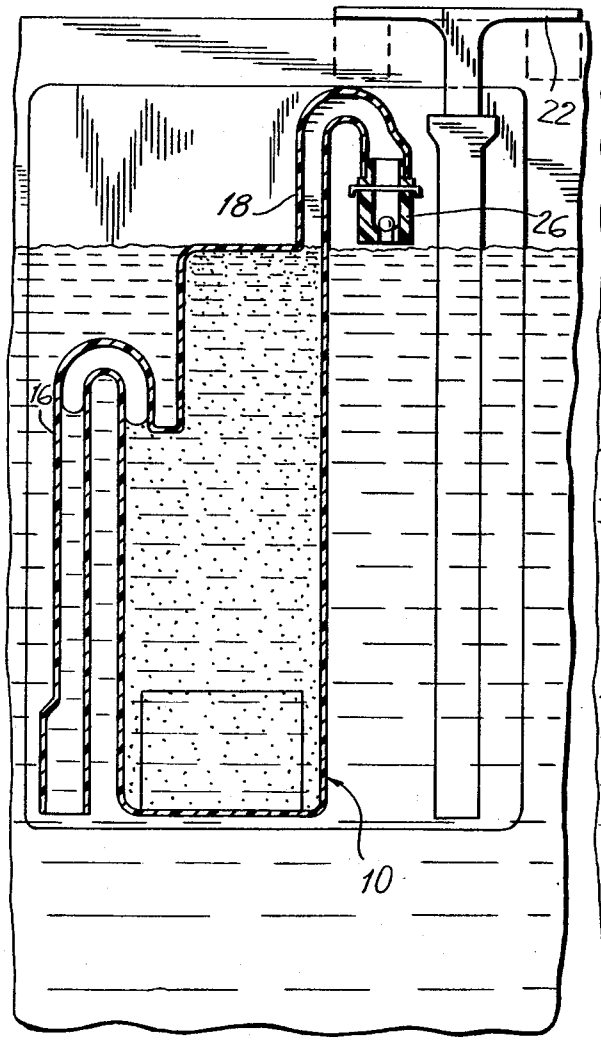
FIG. 14 is a view of FIG. 13 during the quiescent period.
Figure 13:
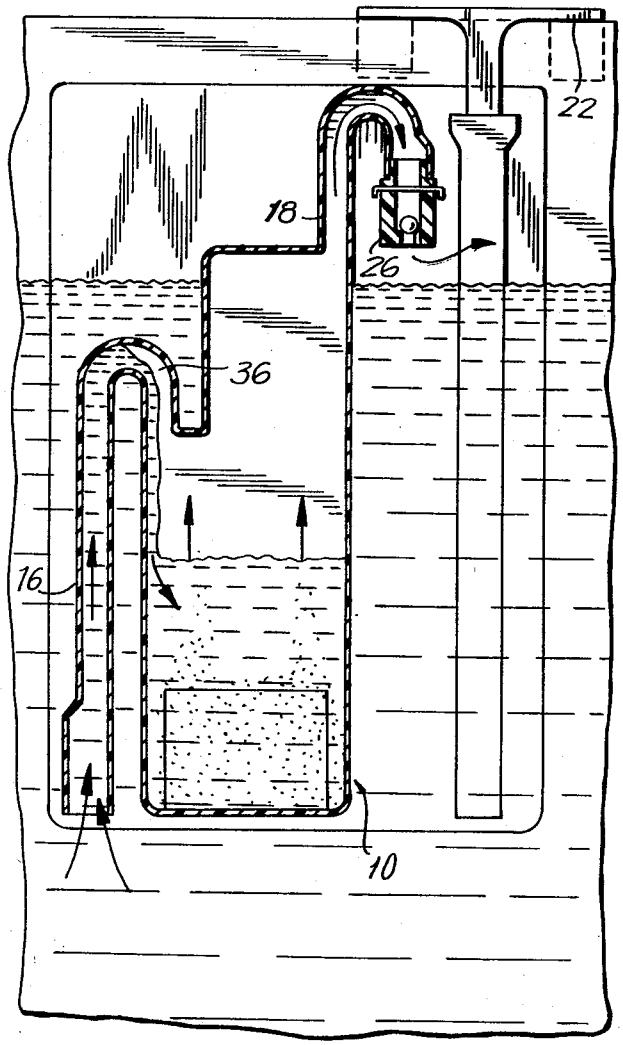
FIG. 13 is a view of an alternate embodiment of the invention shown during a portion of the filling cycle.

Referring now to FIGS. 13, 14 and 15 and alternate embodiment of dispenser 10 is shown having ball valve housing 26 inverted and adapted to air vent tube 18/. FIG. 13 shows the operation of the dispenser during a portion of the filling cycle where the restriction of air being pushed through vent 18 by water entering tube 16 slows the water flow sufficiently to create an air space 36 which develops into an air bubble 38 during the quiescent period shown in FIG. 14. Operation of the dispenser during the discharge portion of the cycle shown in FIG. 15 is similar to that described above with respect to FIG. 4. It will be noted that the ball may be displaced slightly from its seat due to the pressure differential created by the water flowing from container 14.

It will be understood by those skilled in the art that numerous modifications and improvements may be made to the embodiments of the invention disclosed herein without departing from the spirit and scope thereof.

What is claimed is:

1. In a dispenser for the controlled-rate release of a substance into a toilet tank, said dispenser having an inlet/outlet means for alternately receiving and discharging liquid into and from said dispenser, said inlet/-outlet means being a single conduit, said dispenser having an air vent tube for communicating the interior of said dispenser to atmospheric pressure, the improvement comprising:

valve means situated in the water flow path within said dispenser for restricting the flow of water into said dispenser during the filling cycle of said dispenser in order to enable the formation of an air bubble in said inlet/outlet means to prevent fluid communication between the interior and exterior of said dispenser during quiescent periods.

2. An apparatus according to claim 1 wherein said valve means comprises:

a valve seat in said inlet/outlet means, said valve seat having at least one predetermined arcuate gap to enable a predetermined leakage of fluid past said valve seat;

a ball valve for seating against said valve seat;

a retaining means for retaining said ball valve within said valve means when it is not in contact with said valve seat.

3. An apparatus according to claim 1 wherein said valve means comprises:

a flap having an aperture of a predetermined size;

a hinge means for hingedly securing said flap in said inlet/outlet means;

a stop for limiting motion of said flap in the direction of water flow during the time water is entering the dispenser.

4. An apparatus according to claim 1 wherein said valve means comprises:

an elastomeric flap, the size of said flap being smaller than the interior of said inlet/outlet means;

means for securing said flap transversely within said inlet/outlet means;

stop means for limiting motion of said flap in the direction of water flow during the time water is entering the dispenser.

* * * * *